US012679510B2

(12) United States Patent
Lombino

(10) Patent No.: US 12,679,510 B2
(45) Date of Patent: Jul. 14, 2026

(54) WATERCRAFT FIN BOX WITH RETRACTABLE FIN

(71) Applicant: SOL Paddle Boards, Inc, Telluride, CO (US)

(72) Inventor: Christopher John Lombino, Telluride, CO (US)

(73) Assignee: SOL Paddle Boards, Inc, Telluride, CO (US)

( * ) Notice: Subject to any disclaimer, the term of this patent is extended or adjusted under 35 U.S.C. 154(b) by 459 days.

(21) Appl. No.: 18/372,529

(22) Filed: Sep. 25, 2023

(65) Prior Publication Data

US 2024/0109624 A1 Apr. 4, 2024

Related U.S. Application Data

(60) Provisional application No. 63/412,330, filed on Sep. 30, 2022.

(51) Int. Cl.
*B63B 32/66* (2020.01)

(52) U.S. Cl.
CPC ..... *B63B 32/66* (2020.02)

(58) Field of Classification Search
CPC ..... B63B 32/66; B63B 32/64; B63B 32/60; B63B 3/38; B63B 1/28; B26B 5/003
USPC ..... 441/79
See application file for complete search history.

(56) References Cited

U.S. PATENT DOCUMENTS

| | | | | |
|---|---|---|---|---|
| 3,087,173 | A * | 4/1963 | Meyer | B63B 32/30 441/79 |
| 5,129,344 | A | 7/1992 | Ono | |
| 5,356,324 | A | 10/1994 | Cunningham | |
| 6,135,837 | A * | 10/2000 | Giles | B63B 32/64 441/74 |
| 10,046,836 | B2 | 8/2018 | Hall | |
| 11,535,342 | B2 | 12/2022 | Lombino | |
| 2013/0017743 | A1* | 1/2013 | Green | B63B 32/40 441/79 |
| 2017/0096199 | A1* | 4/2017 | Hall | B63B 32/66 |

* cited by examiner

*Primary Examiner* — Lars A Olson
*Assistant Examiner* — Eric Anthony Starck
(74) *Attorney, Agent, or Firm* — Critical Path IP Law, LLC

(57) ABSTRACT

Systems and methods to provide a watercraft fin box with a retractable fin. The fin box may be fitted to a watercraft such as an inflatable paddle board. The retractable fin is associated with a lever that allows the retractable fin to rotate within a body of the fin box. An elastic member positioned within the body of the fin box operates to urge the retractable fin away from the body when the retractable fin rotates into the body. The elastic member does not urge the retractable fin away from the body when the fin box is fitted to a watercraft and the retractable fin of the fin box is positioned to face the Earth, such as when the watercraft is placed atop water with the retractable fin immersed in water.

20 Claims, 10 Drawing Sheets

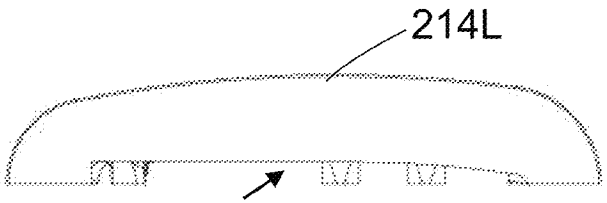
Fig.8A
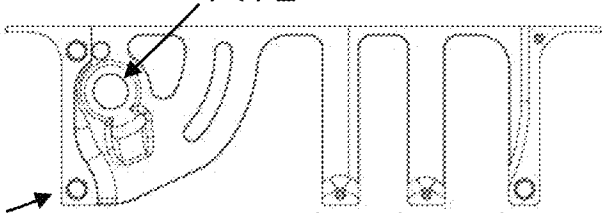
Fig.8B
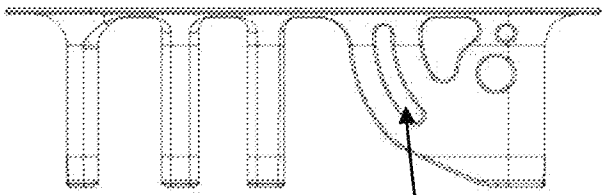
Fig.8C
Fig.8D
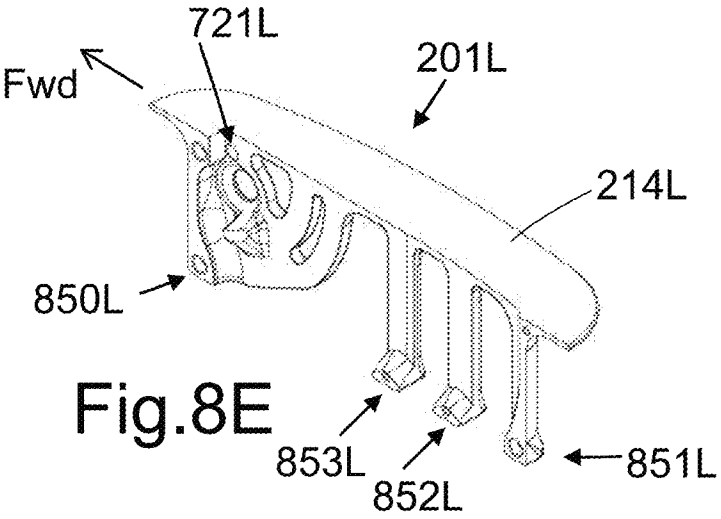
Fig.8E

WATERCRAFT FIN BOX WITH RETRACTABLE FIN

CROSS-REFERENCE TO RELATED APPLICATION

This application is a nonprovisional patent application of and claims the benefit of U.S. Provisional Patent Application No. 63/412,330 titled "Paddle Board Fin Box with Retractable Fin" filed Sep. 30, 2022, the disclosure of which is hereby incorporated herein by reference in entirety.

FIELD

The disclosure relates generally to a fin box with a retractable fin, and specifically to a fin box with a retractable fin fitted to a watercraft such as a paddle board.

BACKGROUND

Watercraft, such as paddle boards, are in broad recreational use in many water environments for a variety of purposes, spanning ocean and river use for exercise to serve as a yoga platform. Paddle boards are of a rigid type and an inflatable type and are commonly referred to as stand-up paddle boards. Inflatable paddle boards strive to provide similar paddle board characteristics to a rigid paddle board yet allow much easier transport and storage. Paddle boards and many other types of water boards, such as surfboards and windsail boards, have one or more fins that aid in lateral stability of the board. These fins are prone to damage, such as when striking a rock in a river or striking a lake bottom when entering or exiting a lake.

What is needed is a retractable fin contained or housed in a fin box, the retractable fin presenting a fully extended state in nominal operation, yet retracting when encountering a force or impact. The retractable fin should travel back to the fully extended position when such force or impact is removed. This disclosure solves this need.

SUMMARY

Systems and methods to provide a watercraft fin box with a retractable fin. The fin box may be fitted to a water board such as an inflatable paddle board. The retractable fin is attached to a lever that allows the retractable fin to rotate within a body of the fin box. An elastic member positioned within the body of the fin box operates to urge the retractable fin away from the body when the retractable fin rotates into the body yet does not so urge nor contact the lever or the retractable fin when the fin box is fitted to a water board and placed atop water with the retractable fin immersed in water.

In one embodiment, a watercraft fin box is disclosed, the watercraft comprising: a body comprising a track aperture and a body lever rotation point, the body forming a body interior void and configured to couple to the watercraft; a retractable fin with a lever, the lever comprising an end lever post and a medial lever post, the end lever post configured to rotate about the body lever rotation point and the medial lever post configured to engage the track aperture; and an elastic element coupled to the body; wherein: the retractable fin operates in a first state extending from the body such that the lever is not engaged with the elastic element; and the retractable fin operates in a second state at least partially extending into the body interior void such that the lever is engaged with the elastic element and the elastic element urges the retractable fin out from the body interior void.

In one aspect, the elastic element is of spherical shape. In another aspect, a medial lever post operates to travel within the track aperture as the retractable fin moves between the first state and the second state. In another aspect, the watercraft is a paddle board. In another aspect, the body is configured to fit within a thickness of the watercraft. In another aspect, when the watercraft fin box is positioned with the retractable fin positioned to extend toward the Earth, the retractable fin rests in the first state. In another aspect, the body comprises a left body and a right body, the left body and the right body separable from one another. In another aspect, the lever is detachable from the retractable fin In another aspect, the medial lever post travels within the track aperture as the retractable fin travels between the first state and the second state.

In another embodiment, a method of using a watercraft fin box is disclosed, the method comprising: providing a watercraft fin box comprising: a body comprising a track aperture and a body lever rotation point, the body forming a body interior void and configured to couple to the watercraft; a retractable fin with a lever, the lever comprising an end lever post and a medial lever post, the end lever post configured to rotate about the body lever rotation point and the medial lever post configured to engage the track aperture; and an elastic element coupled to the body; positioning the body within a thickness of the watercraft; placing the watercraft atop water such that the retractable fin is immersed in water; wherein: the retractable fin operates in a first state extending from the body such that the lever is not engaged with the elastic element; and if the retractable fin encounters a force that impacts the retractable fin, the retractable fin operates in a second state at least partially extending into the body interior void such that the lever is engaged with the elastic element and the elastic element urges the retractable fin out from the body interior void.

In one aspect, the elastic element is of a spherical shape. In another aspect, a medial lever post operates to travel within the track aperture as the retractable fin moves between the first state and the second state. In another aspect, an end lever post of the lever is configured to rotate about a lever rotation point of the body as the retractable fin moves between the first state and the second state. In another aspect, the body is disposed within a thickness of the paddle board. In another aspect, the watercraft is a paddle board. In another aspect, the lever is detachable from the retractable fin. In another aspect, the body comprises a left body and a right body, the left body and the right body separable from one another. In another aspect, the body is configured to fit within a thickness of the watercraft.

In yet another embodiment, a watercraft fin box is disclosed, the water board fin box comprising: a body comprising a track aperture and a body lever rotation point, the body forming a body interior void and configured to couple to the water board; a lever, the lever comprising an end lever post and a medial lever post, the end lever post configured to rotate about the body lever rotation point and the medial lever post configured to engage the track aperture; a retractable fin configured to attach to the lever; and an elastic element attached to the body; wherein: the retractable fin operates in a first state extending from the body such that the elastic element does not impart a force on the lever; and the retractable fin operates in a second state at least partially extending into the body interior void such that the elastic element does impart a force on the lever to urge the retractable fin out from the body interior void.

In one aspect, the elastic element is of spherical shape; the body comprises a left body and a right body, the left body and the right body separable from one another; and the medial lever post travels within the track aperture as the retractable fin travels between the first state and the second state.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably. The terms "determine", "calculate" and "compute," and variations thereof, as used herein, are used interchangeably and include any type of methodology, process, mathematical operation or technique.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The disclosure will be readily understood by the following detailed description in conjunction with the accompanying drawings, wherein like reference numerals designate like elements. The elements of the drawings are not necessarily to scale relative to each other. However, FIGS. 1, 2A-D, 3A-D, 4, 5, 6A-B, 7A-E, 8A-E, and 9A-E are scaled drawings. Identical reference numerals have been used, where possible, to designate identical features that are common to the figures.

FIG. 1 is a bottom view of an inflatable paddle board of the prior art with the installation location of the fin box of the disclosure identified;

FIG. 2A is a top view of one embodiment of the fin box with the retractable fin in a fully extended state and the elastic element uncompressed;

FIG. 2B is a side view of the fin box of FIG. 2A;

FIG. 2C is a front view of the fin box of FIG. 2A;

FIG. 2D is a perspective view of the fin box of FIG. 2A;

FIG. 3A is a top view of the fin box of FIG. 2A with the retractable fin in a retracted state and the elastic element compressed;

FIG. 3B is a side view of the fin box of FIG. 3A;

FIG. 3C is a front view of the fin box of FIG. 3A;

FIG. 3D is a perspective view of the fin box of FIG. 3A;

FIG. 4 is a cross-sectional side view of the fin box of FIG. 2A, the right half side of the fin box body removed for clarity, the retractable fin in a fully extended state and the elastic element uncompressed;

FIG. 5 is a cross-sectional side view of the fin box of FIG. 3A, the right half side of the fin box body removed for clarity, the retractable fin in a retracted state and the elastic element compressed;

FIG. 6A is a cross-sectional side view of another embodiment of the fin box with the retractable fin in a fully extended state and the elastic element uncompressed, the right half side of the fin box body removed for clarity;

FIG. 6B is a cross-sectional side view of the fin box of FIG. 6A with the retractable fin in a retracted state and the elastic element compressed, the right half side of the fin box body removed for clarity;

FIG. 7A is a top view of the right half side of the fin box body of the embodiment of the fin box of FIG. 2A;

FIG. 7B is a first side view of the right half side of the fin box body of FIG. 7A;

FIG. 7C is a front view of the right half side of the fin box body of FIG. 7A;

FIG. 7D is a second side view of the right half side of the fin box body of FIG. 7A;

FIG. 7E is a perspective view of the right half side of the fin box body of FIG. 7A;

FIG. 8A is a top view of the left half side of the fin box body of the embodiment of the fin box of FIG. 2A;

FIG. 8B is a first side view of the left half side of the fin box body of FIG. 8A;

FIG. 8C is a front view of the left half side of the fin box body of FIG. 8A;

FIG. 8D is a second side view of the left half side of the fin box body of FIG. 8A;

FIG. 8E is a perspective view of the left half side of the fin box body of FIG. 8A;

FIG. 9A is a top view of the lever of the fin box of the embodiment of the fin box of FIG. 2A;

FIG. 9B is a rear view of the lever of FIG. 9A;

FIG. 9C is a side view of the lever of FIG. 9A;

FIG. 9D is a front view of the lever of FIG. 9A;

FIG. 9E is a perspective view of the lever of FIG. 9A; and

It should be understood that the proportions and dimensions (either relative or absolute) of the various features and elements (and collections and groupings thereof) and the boundaries, separations, and positional relationships presented there between, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments. The following descriptions are not intended to limit the embodiments to one preferred embodiment. To the contrary, it is intended to cover alternatives, modifications, and equivalents as can be included within the spirit and scope of the described embodiments as defined, for example, by the appended claims.

The disclosed devices, systems, and methods of use will be described with reference to FIGS. 1-10. Generally, systems and methods to provide a fin box for a watercraft are described, the fin box having a retractable fin. In a first state, the retractable fin is in a fully extended state. The first state is the resting or natural state of the retractable fin and is a static and stable state. In a second state, the retractable fin retracts at least partially within the fin box, the retractable fin engaging an elastic member which urges the retractable fin away from the interior of the fin box. The second state is a dynamic and unstable state. The fin box may be fitted to existing or modified watercraft such as water boards, to include, without limitation, rigid or non-inflatable paddle boards, inflatable paddle boards, windsurfing boards, and surf boards.

Although the disclosed devices, systems, and methods of use will be described relative to an inflatable paddle board for use with recreational water sport activities and the like, the devices, systems, and methods of use have other applications. For example, the fin box with retractable fin may be adapted or fitted or coupled to other structures or devices, such as inflatable structures associated with any watercraft or water floatation device to include tubing devices.

Generally, the disclosed fin box comprises a retractable fin attached to a lever that allows the retractable fin to rotate within a body of the fin box. An elastic member positioned within the body of the fin box operates to urge the retractable fin away from the body when the retractable fin rotates into the body yet does not so urge nor contact the lever or the retractable fin when the fin box is fitted to a water board and the water board is placed in its nominal resting state, such as when placed atop water with the retractable fin immersed in water.

Figure 1:
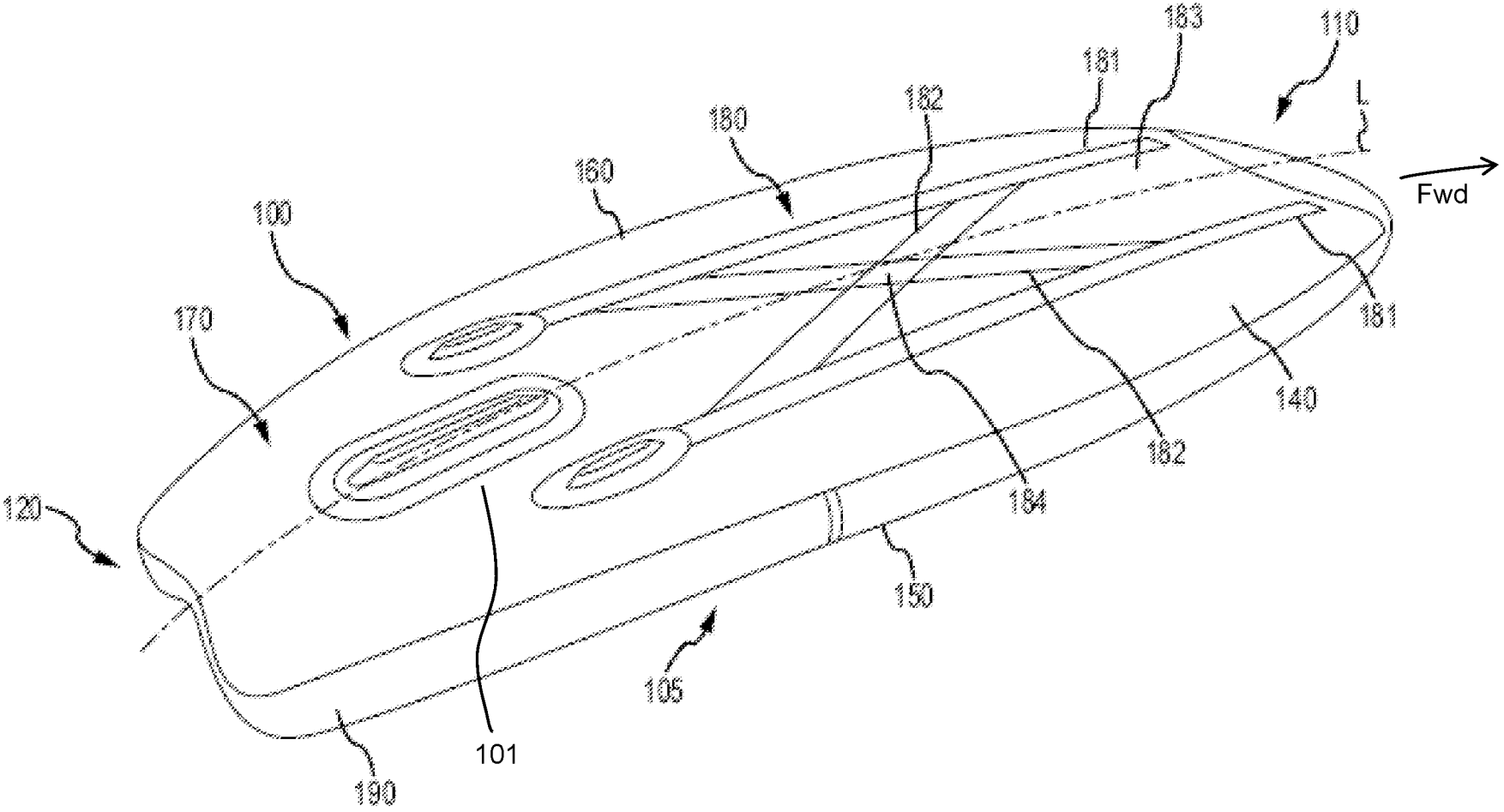
Fig.1 (Prior Art)

FIG. 1 is a bottom view of an inflatable paddle board 100. The location of the fin box of the disclosure is shown as fin box location 101. The described fin box embodiments may be referred to as "box" or "device" or "system." The method of use of any of the described fin box embodiments may be referred to as "method." The inflatable water board or any water floatation device of which the fin box may be attached or fitted or couple with may be referred to as "paddle board" or "water board."

The inflatable paddle board 100 of FIG. 1 comprises a forward portion 110, a rearward portion 120, an upper surface 150, lower surface 140, and thickness 190. The fin box of the disclosure is fitted within an aperture or void within the inflatable paddle board 100, such an aperture or void located at fin box location 101. Stated another way, the fin box of the disclosure fits within an aperture of the inflatable paddle board 100 at fin box location 101. In one embodiment, the fin box upper and/or lower surfaces present a flush or and/or parallel surface relative to one or both of the upper surface 150 and lower surface 150.

The fin box with retractable fin securely fits within thickness 190 at fin box location 101 by any of various attachment means, to include, for example, as an interference fit or through any of various attachment means known to those skilled in the art (e.g., via adhesive such as glues). In one embodiment, the bulging of the water board (which may comprise PVC material) fin box aperture, at fin box location 101, puts pressure on the inserted fin box to hold the fin box securely in place.

Note that the inflatable paddleboard 10, when in its natural or notional or rest state (the "paddle board notional operating state"), is flipped over from that depicted in FIG. 1 such that the lower surface 140 engages or interacts with water (and faces down toward Earth) and the upper surface 150 faces upwards (and thus faces upwards away from Earth) and engages any user standing atop the inflatable paddleboard 10. The paddleboard operates to travel in the direction identified as Fwd in FIG. 1.

The inflatable paddle board of FIG. 1 is from U.S. Pat. No. 11,535,342 to Lombino entitled "Inflatable Paddleboard with Exterior Stringer System" and is incorporated by reference in entirety for all purposes.

FIGS. 2A-D and 3A-D depict one embodiment of a complete fin box 200, the fin box 200 comprising a retractable fin 290. In FIGS. 2A-D, the retractable fin 290 is shown in a first state in which the retractable fin 290 is in a fully (or substantially fully) extended state. (The term "substantially" means essentially or fundamentally, and when applied to the retractable fin, the fin extends at least 90% of its maximum extension). In FIGS. 3A-D, the retractable fin 290 is shown in a second state in which the retractable fin 290 is in a retracted state.

The first state of the retractable fin is a notional, default, nominal or rest state with the retractable fin in a fully extended state and the elastic element 240 (described below) uncompressed. The first state is a stable state. The first state is the state the retractable fin 290 normally resides. For example, a fin box 200 installed in an inflatable paddle board 100 (at fin box location 101), when the inflatable paddle board 100 is in its paddle board notional operating state (defined above), presents a retractable fin 290 in the first state. Note that, among other things, the force of gravity (identified as G in FIG. 2B) urges the retractable fin 290 to the first state. Stated another way, when the watercraft fin box 200 is positioned with the retractable fin 290 positioned to extend toward the Earth (such as when the watercraft fin box is fitted to a paddleboard and the paddleboard is placed atop water), the retractable fin rests in the first state.

The second state of the retractable fin 290 is a dynamic or transitory state in which the retractable fin 290 at least partially rotates to reside partially within the body 201 of the fin box 200. The second state is a dynamic and unstable state. In the second state, the elastic element 240 is at least partially compressed and operates to urge the retractable fin away from or out of the body 201. FIGS. 3A-D depict the retractable fin 290 in a maximum retractable position, meaning that the retractable fin 290 cannot retreat or rotate or reside within the body 200 to any greater degree.

Note that other states of the retractable fin 290 are possible between the first state and the second state, such as a third state in which the retractable fin 290 partially rotates to reside at a position less than a maximum degree within the body 200.

The fin box 200 comprises a body 201 with a track aperture 215, a lever 230 configured to engage the track aperture 215, a retractable fin 290 coupled or attached to the lever 230, and an elastic element 240 coupled to or disposed within the body 201. The term "elastic" means capable of recovering size and shape after a deformation.

Figure 2D:
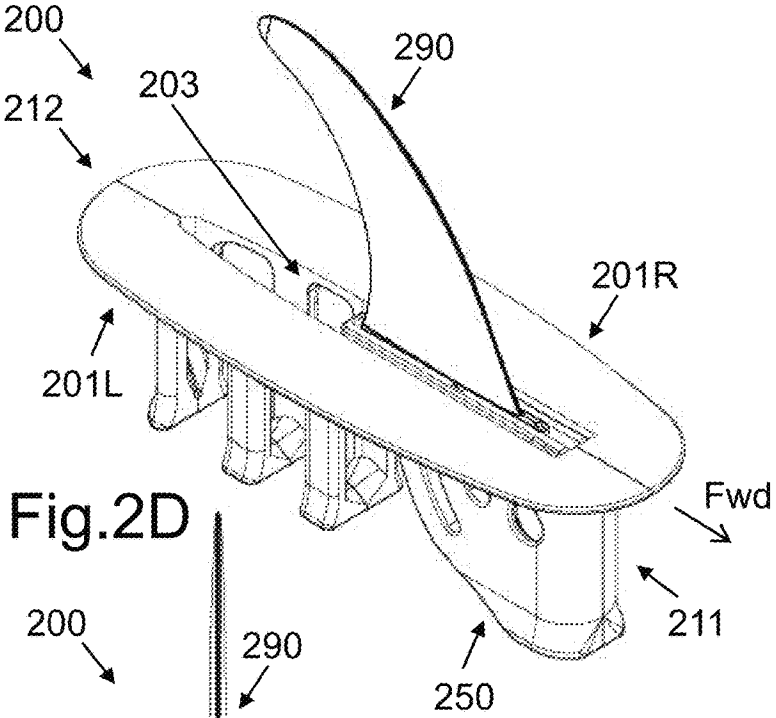
Figure 2C:
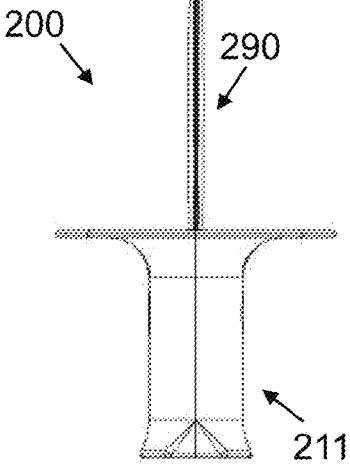
Figure 2A:
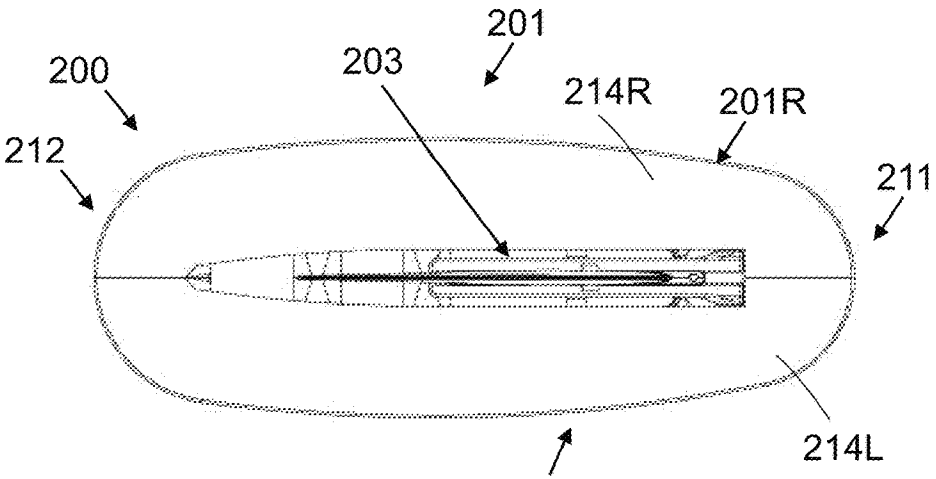
Figure 2B:
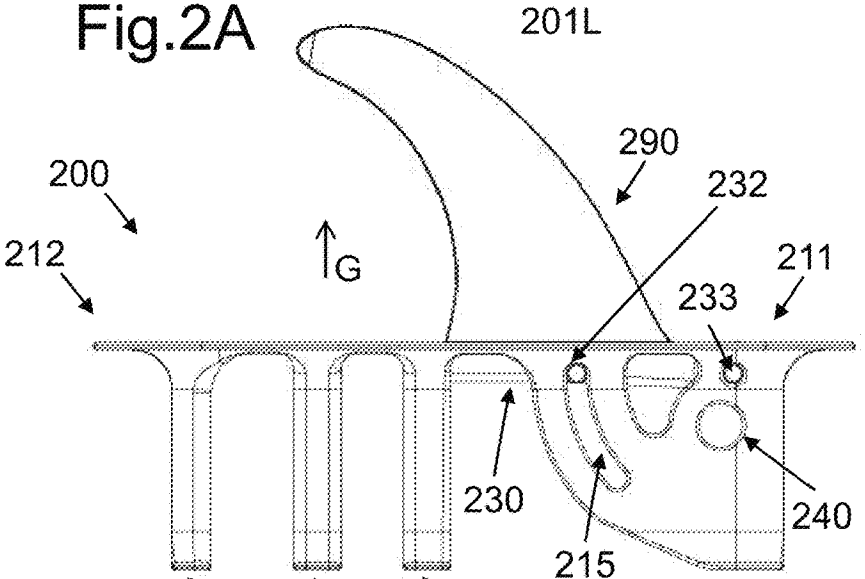
Figure 3D:
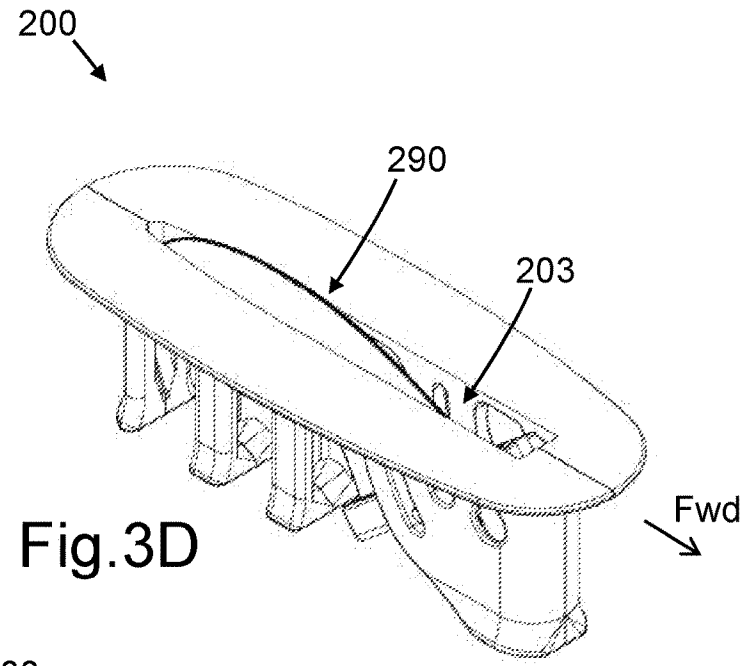
Figure 3C:
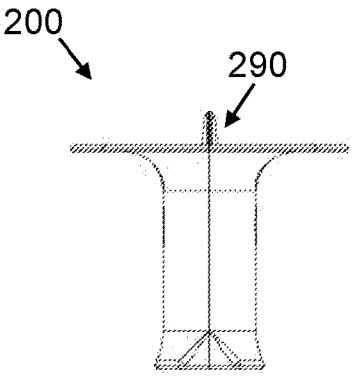
Figure 3A:
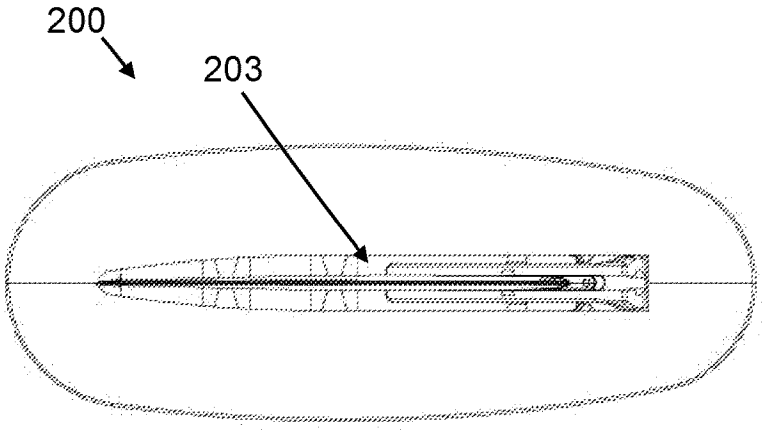
Figure 3B:
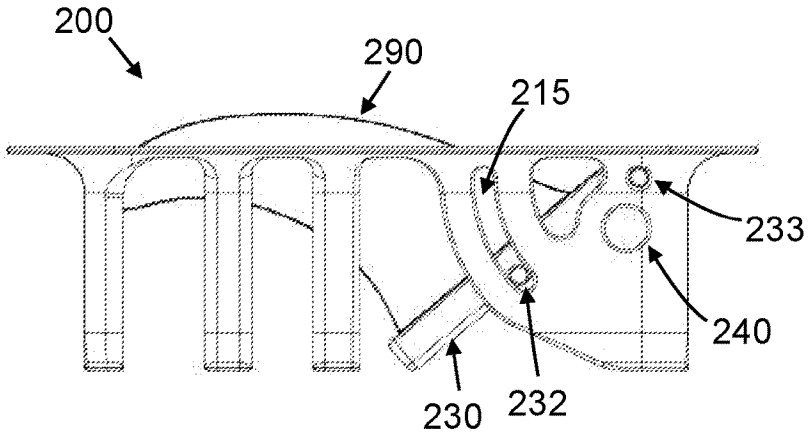

The body 201 of the fin box 200 has a fin box front 211 (which when installed in a paddle board faces the nose or front or tip of a paddle board, the direction indicated as Fwd in FIG. 2D), a fin box rear 212 (which when installed in a paddle board faces the rear of a paddle board), a fin box upper 213 (which when installed in a paddle board faces or is flush or parallel with the upper surface of a paddle board, e.g., flush or parallel with the upper surface 150 of FIG. 1), a fin box lower surface 214 (which when installed in a paddle board faces or is flush or parallel with the lower surface of a paddle board, e.g., flush or parallel with the lower surface 140 of FIG. 1), a fin box nose 250, and a set of three legs comprising first leg 253, second leg 252, and third leg 251. The body 201 is configured to fit within all or most of the thickness of a paddle board (see thickness 190 of FIG. 1). The body 201 forms a body interior void 203 configured to receive the lever 230 and retractable fin 290. More specifically, the body interior void 203 is configured to enable the lever 230 to rotate within the body interior void 203, as described in detail below.

Other configurations of the body 201 are possible, such as configurations with fewer or more legs, no legs, a nose portion that extends to one or more of the legs of the embodiment of FIGS. 2A-D and 3A-D.

The body 201 is comprised of two paired portions: left body 201L and right body 201R. The paired portions 201L and 201R are generally symmetrical yet comprise male/female matching or paired portions to allow joining (see FIGS. 7A-E and 8A-E for additional details). The element body 201 refers to the combination of left body 201L and right body 201R. Any or all of the fin box 200 components, to include the body 201, lever 230, and retractable fin 290, may be formed through 3-d printing or ejection molding.

The lever 230 has a medial lever post 232 and end lever post 233. (See FIGS. 9A-E for additional lever details). The lever 230 rotates within body 201 about the end lever post 233. As the lever 230 rotates (into the body 201), the medial lever post 232 moves within or along the track aperture 215 of the body 201. The retractable fin 290 is attached to the lever 230 such that the retractable fin 290 rotates with the lever 230 rotation. Thus, as the lever 230 rotates into the body 201, the retractable fin 290 rotates into the body 290.

The elastic element 240 may be any elastic device, to include a rubber or rubberized sphere, such as a commercially available racquetball. In one embodiment, the elastic element is a commercially available, standard racquetball with a diameter of 57 mm. In one embodiment, the elastic element is detachable and/or replaceable. The elastic element is positioned within an elastic body aperture formed by the left elastic body aperture 717L (See FIG. 8B) and the right elastic body aperture 717R (See FIG. 7B). In some embodiments, the elastic member is permanently attached to the elastic body aperture. In some embodiments, the elastic member is detachable and/or removeable from the elastic body aperture. In some embodiments, the elastic member is substantially a spherical shape. In some embodiments, the elastic member is any shape that functions as described (e.g., to urge the retractable fin away from or out of the fin box when the fin is rotated into the fin box) as known to those skilled in the art.

The retractable fin 290, and the combined retractable fin 290 and lever 230 combination (a combination formed by the nature of the retractable fin 290 being coupled to or connected to or attached to the lever 230), operate in any of several states. (The term "state" means a condition of a thing or device; for example, a device state may be an undeformed state or a deformed state, an extended state or a retracted state). As mentioned above, the retractable fin 290 may operate in a first state extending from the body 201 such that the lever 230 is not engaged with the elastic element 240 (as depicted in FIGS. 2A-D). The first state of the retractable fin 290 may also be referred to as a fully extended state or a rest state or a nominal state or a notional state. The retractable fin 290 may operate in a second state at least partially extending into the body 201 such that the lever 230 is engaged with the elastic element 240 and the elastic element 240 urges the retractable fin 290 away from the body 201. (FIGS. 3A-D depict the retractable fin 290 in a fully retracted state).

Figure 4:
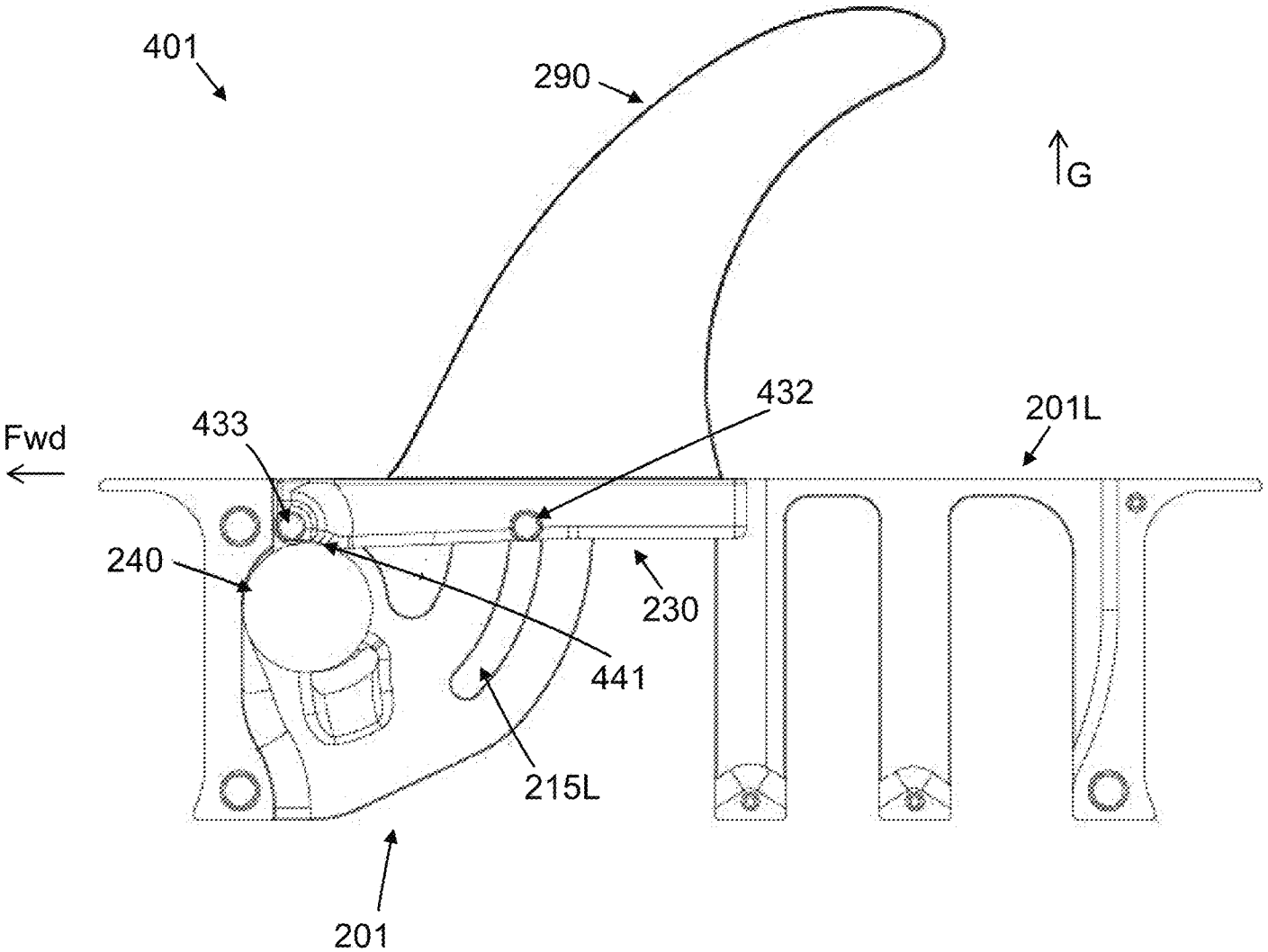

When the retractable fin 290 is in the fully extended state or the rest state or the nominal state or the notional state (the first state described above), the lever 230 is not engaged with and/or not making physical contact with the elastic element 240. (See FIG. 4 showing elastic element gap 441 between the elastic element 240 and the lever 230, the gap being a physical void or aperture or space between the elastic element 240 and the lever 230). In some embodiments, when the retractable fin is fully or substantially fully extended, the elastic element 240 does not urge the lever 230 and/or the retractable fin 290 away from or out of the fin body 201. In some embodiments, when the retractable fin is fully or substantially fully extended, the elastic element 240 does not impart a force to rotate or push the lever 230 and/or the retractable fin 290 away from or out of the fin body 201.

When the retractable fin 290 is in a partially or fully rotated position or state (e.g., the second state described above) and thus the attached lever 230 is similarly in a partially or fully rotated position or state (See, e.g., FIG. 5 in which the retractable fin and lever combination are in a fully rotated position), the lever 230 is engaged with the elastic element 240 which becomes compressed, in turn creating a force of resistance or urging that pushes against the lever 230 to urge the lever to rotate away from the body 201.

In some embodiments, the retractable fin 290 and lever 230 are one integrated structure (formed, e.g., through 3-d printing or ejection molding). In some embodiments, the retractable fin 290 and lever 230 are detachable, separate components configured to attach or couple to one another.

Figure 5:
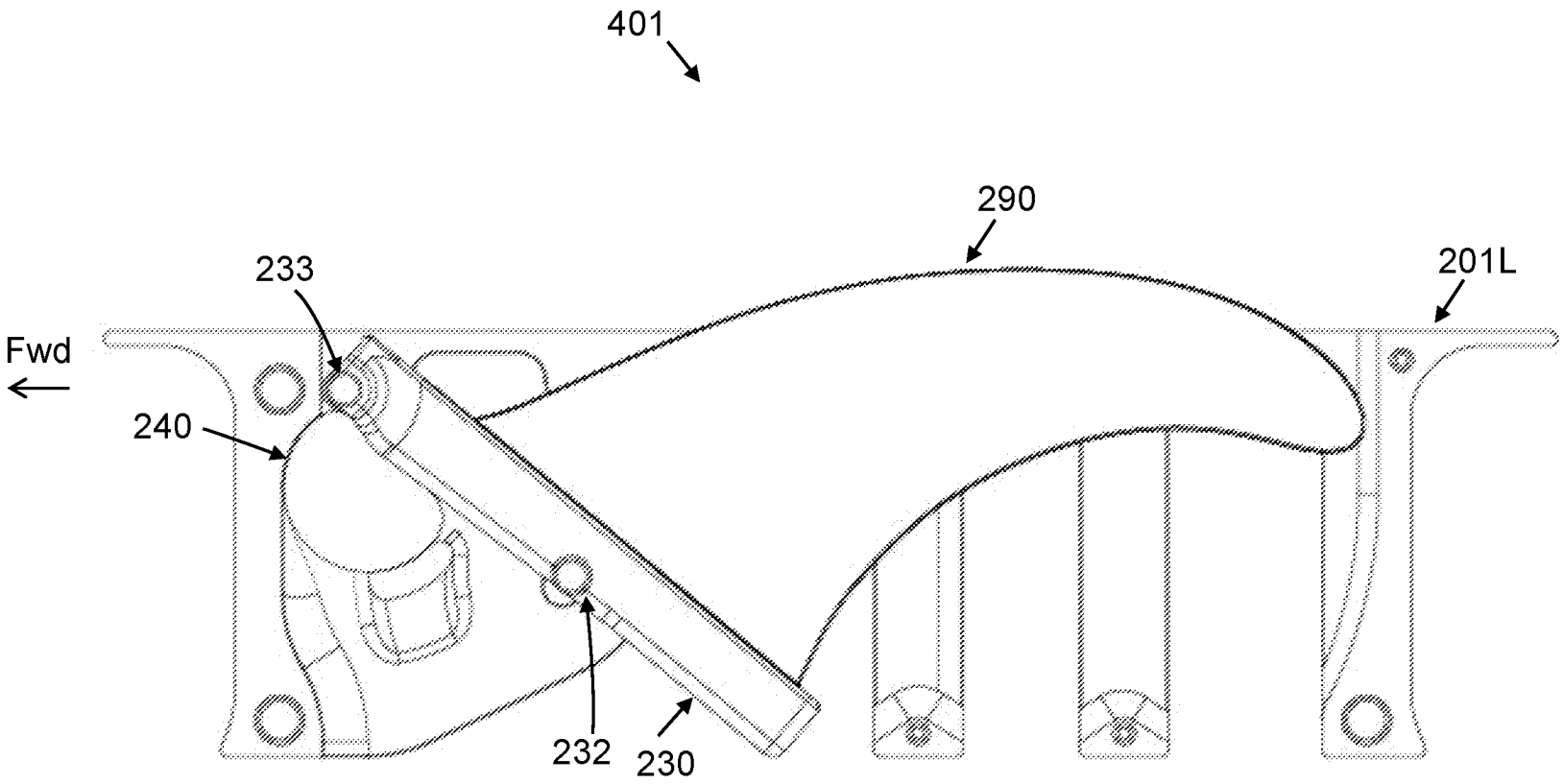
Figure 6A:
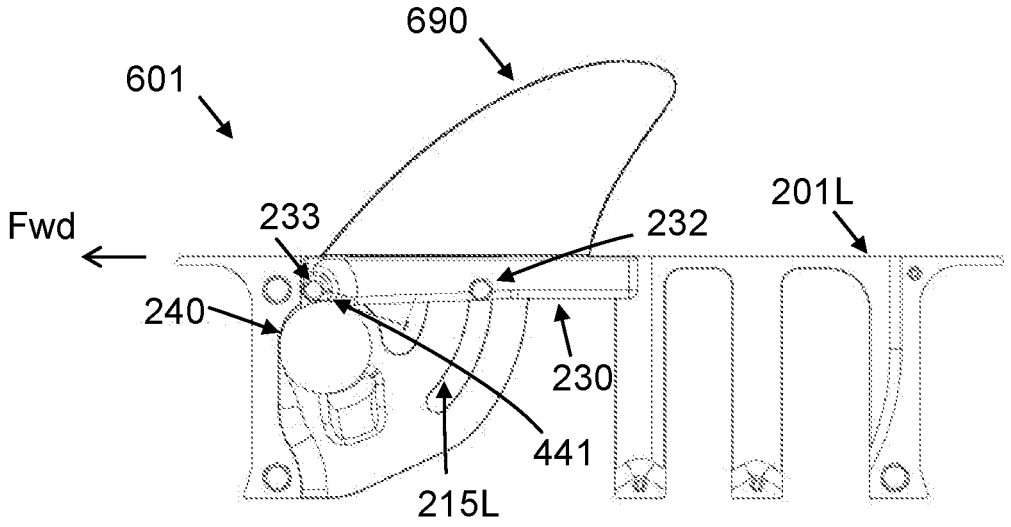
Figure 6B:
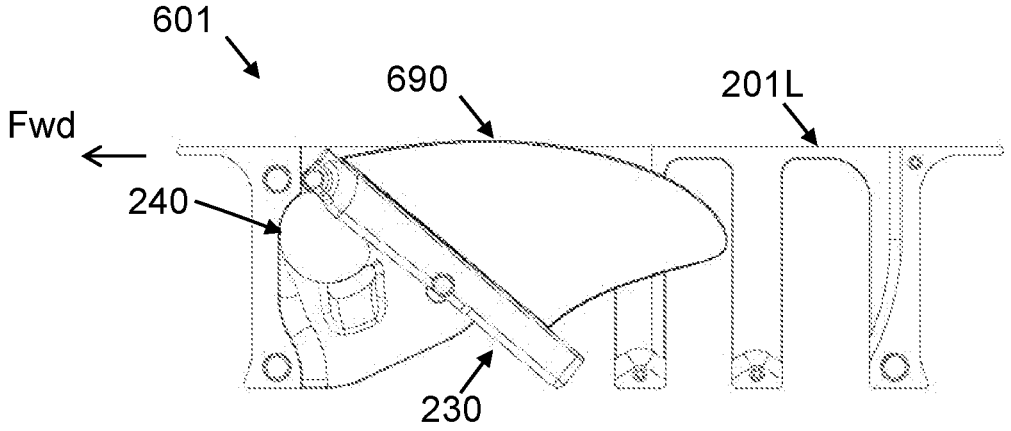
Figures 7A, 7B, 7C, 7D, 7E:
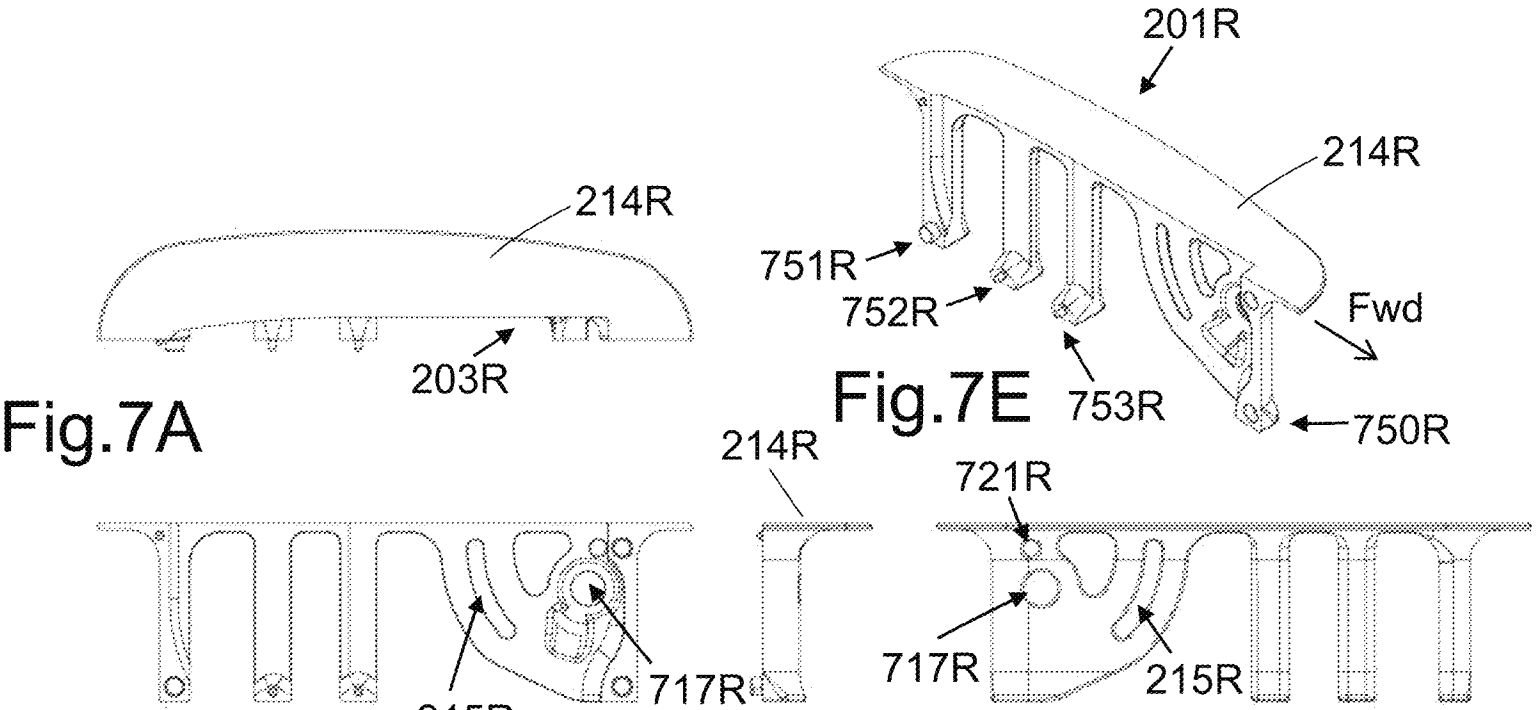
Figure 9E:
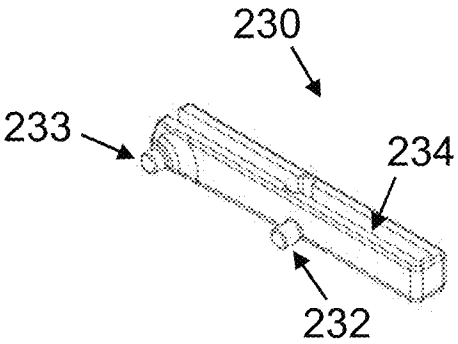
Figure 9D:
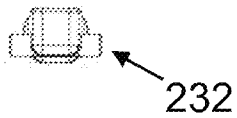
Figure 9A:
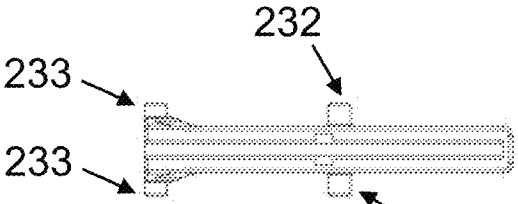
Figure 9C:
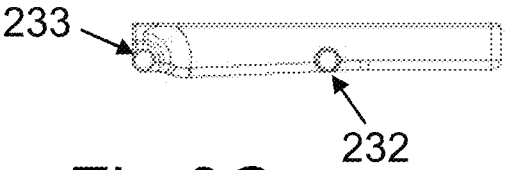
Figure 9B:
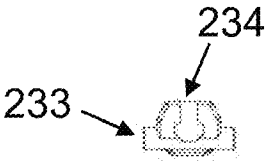

The retractable fin 290 may be of varied sizes and shapes. In one embodiment, the lever 230 is of a standardized configuration to accommodate or receive a set of retractable fins 290, such fins configured with a base portion that fits within the lever slot 934 (See FIGS. 9A-E) of the lever 230. The retractable fin 290 of FIGS. 2A-D, 3A-D, 4, and 5 is an 8-inch retractable fin 290 (the 8 inch is maximum vertical distance of the retractable fin from fin base portion extending out from upper edge of lever slot to fin tip portion). The retractable fin 290 of FIGS. 6A-B is a 4.6-inch retractable fin 290. Other retractable fin sizes include 3-inch and any size known to those skilled in the art.

In one embodiment, one or more inserts are positioned between an exterior surface of the fin box (e.g., fin box lower 214) and a surface of the paddle board to, among other things, ensure a flush or tight fit between the fin box and the paddle board. For example, one or more inserts may be placed between the outside or opposite surfaces of the fin box lower 214 (front and/or rear portions) and the paddle board lower surface 140. Additionally, or alternatively, one or more inserts may be positioned between the fin box nose 250 and the set of three legs comprising first leg 253, second leg 252, and third leg 251 and the upper surface 150. Such an insert may help close or fill a gap or void formed between the fin box and the paddle board due to a curve or bow in the paddle board. The insert may be formed of a rubber or rubberized material, a plastic, or any material known to those skilled in the art to ensure or enable a flush fit between components.

FIG. 4 is a cross-sectional side view of the fin box 401, the right half side of the fin box body 201 removed for clarity, the retractable fin 290 in a fully extended (first) state and the elastic element 240 uncompressed. FIG. 5 is a companion cross-sectional side view of the fin box 401, the retractable fin 290 in a retracted (second) state and the elastic element 240 compressed. The end lever post 433 of lever 230 operates to rotate about a body lever rotation point (e.g., 721L in FIG. 8E), while medial lever post 432 travels within left track aperture 215L of left body 201L. (Note that when two paired portions left body 201L and right body 201R are joined to form body 201, body lever rotation point 721L and body lever rotation point 721R (See FIG. 7D) form a common, and single, body rotation point. Similarly, when two paired portions left body 201L and right body 201R are joined to form body 201, left track aperture 215L and right track aperture 215R form a common, and single, track aperture 215. And when two paired portions left body 201L and right body 201R are joined to form body 201, left elastic body aperture 717L (See FIG. 8B) and right elastic body aperture 717R (See FIG. 7B) form a common, and single, elastic body aperture). Additionally, when two paired portions left body 201L and right body 201R are joined to form body 201, left body interior void 203L (See FIG. 8A) and right interior void 203R (See FIG. 7A) form a common, and single, body interior void 203.

With attention to FIG. 4, when the retractable fin 290 is in the fully extended (first) state as shown, a lever clearance 441 is formed. The lever clearance 441 is a positional gap or space or void between the surface of the lever 230 and the elastic element 441. In the embodiment shown, the lever clearance 441 is about 0.50 mm. In some embodiments, the lever clearance is at least 0.50 mm. In some embodiments, the lever clearance is about 0.50 mm. In some embodiments, the lever clearance is greater than 0.0 mm or, stated another way, the lever clearance is a value greater than 0.0 mm.

FIGS. 6A-B are a pair of drawings respectively depicting another embodiment of the fin box 601 with the retractable fin 690 in a first (fully extended) state and in a second (retracted) state. In the first state of FIG. 6A, the elastic element 240 is uncompressed and a lever clearance 441 is formed. In the second state of FIG. 6B, the elastic element 240 is compressed and a lever clearance 441 does not exist. Like the fin box 401 of FIGS. 4-5, the end lever post 233 of lever 230 operates to rotate about a body lever rotation point (e.g., 721L of FIG. 8E), while medial lever post 232 travels within left track aperture 215L of left body 201L. The fin box 601 embodiment is similar to the fin box 401 embodiment except that the retractable fin 690 of FIGS. 6A-B is a 4.6-inch retractable fin rather than an 8-inch retractable fin 290.

FIGS. 7A-E and 8A-E respectively depict the paired right body 201R and left body 201L which when joined, create or form the body 201. Right body 201R comprises a fin box nose 750R and a set of three legs comprising first leg 751R, second leg 752R, and third leg 753R. Left body 201L comprises a fin box nose 850L and a set of three legs comprising first leg 851L, second leg 852L, and third leg 853L. The set of first leg 751R, second leg 752R, and third leg 753R comprise plug extensions which fit to the respective first leg 851L, second leg 852L, and third leg 853L in a male-female arrangement to form first leg 253, second leg 252, and third leg 251 (of FIG. 2B). Other joining techniques as known to those skilled in the art, to include for example tongue and grove connections, are possible. The fin box nose 750R and fin box nose 750L join by any joining technique known to those skilled in the art to form fin box nose 250 (See FIG. 2B).

As described above, when two paired portions left body 201L and right body 201R (of respective FIGS. 8A-E and 7A-E) are joined to form body 201, body lever rotation point 721L and body lever rotation point 721R form a common, and single, body rotation point. Similarly, when two paired portions left body 201L and right body 201R are joined to form body 201, left track aperture 215L and right track aperture 215R form a common, and single, track aperture 215. And when two paired portions left body 201L and right body 201R are joined to form body 201, left elastic body aperture 717L and right elastic body aperture 717R form a common, and single, elastic body aperture. Also, when two paired portions left body 201L and right body 201R are joined to form body 201, left body interior void 203L and right interior void 203R form a common, and single, body interior void 203.

Left body 201L comprises many similar features to body 201, to include fin box front (which when installed in a paddle board faces the nose or front or tip of a paddle board), a fin box rear (which when installed in a paddle board faces the rear of a paddle board), a fin box upper (which when installed in a paddle board faces or is flush or parallel with the upper surface of a paddle board, e.g., flush or parallel with the upper surface 150 of FIG. 1), and a fin box lower (which when installed in a paddle board faces or is flush or parallel with the lower surface of a paddle board, e.g., flush or parallel with the lower surface 140 of FIG. 1). The right body 201R has analogous similar features with body 201. The left body 201L, when combined with the companion right body 201R, is configured to fit within all or most of the thickness of a paddle board (see thickness 190 of FIG. 1).

Left body 201L also comprises a body lever rotation point 721L, a point about which the end lever post of the lever rotates. Furthermore, left body 201L comprises elastic element aperture 717L, configured to receive the elastic element; in this embodiment, the elastic element aperture 717L is configured to receive a spherically shaped elastic element as the elastic element aperture 717L is essentially a half-domed cavity. Left body 201L may also comprise an elastic element shelf which may assist in securing the elastic element, among other things, and a left body interior void 203L.

FIGS. 9A-E are a set of perspective views of lever 230. Lever 230 comprises end lever post 233, which is configured to rotate about body lever rotation point (see body lever rotation points 721R and 721L in respective FIGS. 7D and 8E), medial lever post 232 which is configured to move within body track aperture 252, and lever slot 234, which is configured to receive and secure the retractable fin (the attachment means as known to those skilled in the art, to include interference fit, a tongue and groove type arrangement (as depicted) in which the retractable fin is configured to slide into lever slot 234.

Figure 10:
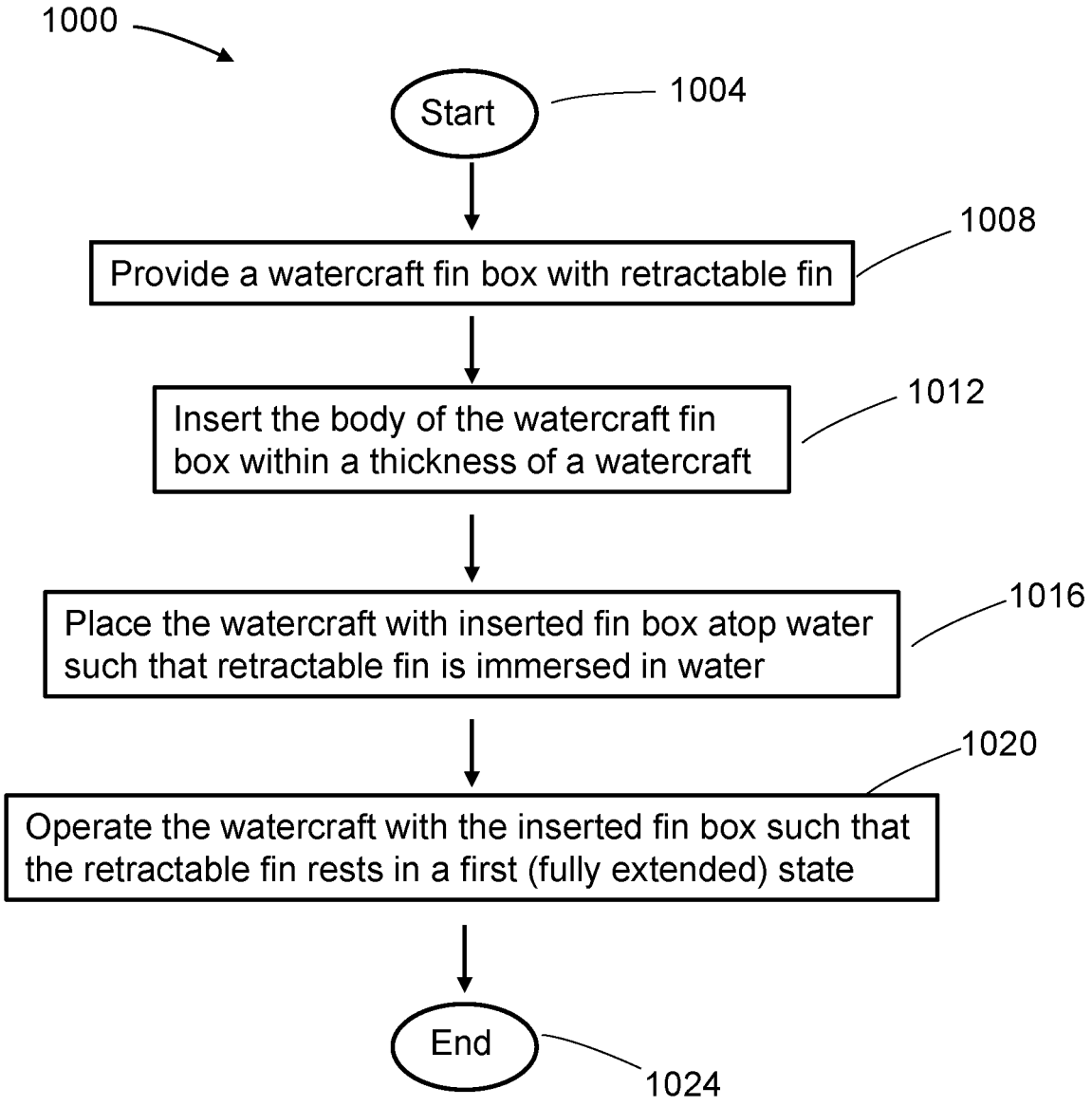
FIG. 10 is a flow chart of one embodiment of a method of use of the fin box of the embodiments of FIGS. 1-9.

FIG. 10 depicts one embodiment of a method of use 1000 of the fin box of the embodiments of FIG. 1-9. Other methods of use are possible, to include a sequence of steps different than those of FIG. 10, a sequence with additional steps, and a sequence with fewer steps.

With particular attention to FIG. 10, a flowchart of a method of use of the fin box is provided, the method 1000 utilizing the elements described in the systems of FIGS. 1-9. Reference may be made to FIGS. 1-9 and to the descriptions of FIGS. 1-9. The method 1000 of FIG. 10 may be applied to other embodiments of the fin box than those of FIGS. 1-7.

The method 1000 starts at step 1004 and ends at step 1024. The steps are notionally followed in increasing numerical sequence, although, in some embodiments, some steps may be omitted, some steps added, and the steps may follow other than increasing numerical order.

At step 1008, a watercraft fin box with a retractable fin is provided. At the completion of step 1008, the method 1000 continues to step 1012.

At step 1012, the watercraft fin box with a retractable fin is inserted within a thickness of the watercraft. In the case of the watercraft being paddleboard, the fin box may be inserted to span most or all of the thickness of the paddleboard. In the case of the watercraft being a boat, the fin box may be inserted only through a portion or the entirety of the hull of the boat. At the completion of step 1012, the method 1000 continues to step 1016.

At step 1016, the watercraft fin box with a retractable fin, as inserted in the watercraft, is positioned toward the Earth, such as placed atop water such that the retractable fin is immersed in water. At the completion of step 1016, the method 1000 continues to step 1020.

At step 1020, the watercraft fin box with a retractable fin, as inserted in the watercraft, is operated toward the Earth such as atop water such that the retractable fin operates in its notional or default state as a fully extended state. In the event the retractable fin encounters a force, such as an impact force from a rock or scraping against a lake bottom, the retractable fin temporarily retracts to at least partially within the fin box body and is urged back to its fully extended position by way of elastic element. At the completion of step 1020, the method 1000 ends.

The exemplary systems and methods of this disclosure have been described in relation to systems and methods involving a fin box with retractable fin, as installed in a water board such as a paddle board. The elements and/or aspects of the disclosure may be applied to other devices, such as a boat, jet ski, aquatic drone, or any watercraft involving or using an extended component such as a fin or rudder. The term "watercraft" means any vehicle or device that can travel or through water, to include, without limitation and for example, boats, ships, jet skis, paddleboards or paddle boards, kayaks, and submarines. However, to avoid unnecessarily obscuring the present disclosure, the preceding description omits a number of known structures and devices, and other applications and embodiments. This omission is not to be construed as a limitation of the scope of the claims. Specific details are set forth to provide an understanding of the present disclosure. It should however be appreciated that the present disclosure may be practiced in a variety of ways beyond the specific detail set forth herein.

A number of variations and modifications of the disclosure can be used. It would be possible to provide for some features of the disclosure without providing others.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein, and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A watercraft fin box comprising:

a body comprising a track aperture and a body lever rotation point, the body forming a body interior void and configured to couple to a watercraft;

a retractable fin with a lever, the lever comprising an end lever post and a medial lever post, the end lever post configured to rotate about the body lever rotation point and the medial lever post configured to engage the track aperture; and an elastic element coupled to the body;

wherein:

the retractable fin operates in a first state extending from the body such that the lever is not engaged with the elastic element; and the retractable fin operates in a second state at least partially extending into the body interior void such that the lever is engaged with the elastic element and the elastic element urges the retractable fin out from the body interior void.

2. The watercraft fin box of claim 1, wherein the elastic element is of spherical shape.

3. The watercraft fin box of claim 1, wherein the medial lever post operates to travel within the track aperture as the retractable fin moves between the first state and the second state.

4. The watercraft fin box of claim 1, wherein the watercraft is a paddle board.

5. The watercraft fin box of claim 1, wherein the body is configured to fit within a thickness of the watercraft.

6. The watercraft fin box of claim 5, wherein when the watercraft fin box is positioned with the retractable fin positioned to extend toward the Earth, the retractable fin rests in the first state.

7. The watercraft of claim 6, wherein the body comprises a left body and a right body, the left body and the right body separable from one another.

8. The watercraft of claim 1, wherein the lever is detachable from the retractable fin.

9. The watercraft of claim 1, wherein the medial lever post travels within the track aperture as the retractable fin travels between the first state and the second state.

10. A method of using a watercraft fin box comprising:

providing the watercraft fin box comprising:

a body comprising a track aperture and a body lever rotation point, the body forming a body interior void and configured to couple to a watercraft;

a retractable fin with a lever, the lever comprising an end lever post and a medial lever post, the end lever post configured to rotate about the body lever rotation point and the medial lever post configured to engage the track aperture; and an elastic element coupled to the body;

positioning the body within a thickness of the watercraft;

placing the watercraft atop water such that the retractable fin is immersed in water;

wherein:

the retractable fin operates in a first state extending from the body such that the lever is not engaged with the elastic element; and if the retractable fin encounters a force that impacts the retractable fin, the retractable fin operates in a second state at least partially extending into the body interior void such that the lever is engaged with the elastic element and the elastic element urges the retractable fin out from the body interior void.

11. The method of claim 10, wherein the elastic element is of a spherical shape.

12. The method of claim 10, wherein the medial lever post operates to travel within the track aperture as the retractable fin moves between the first state and the second state.

13. The method of claim 12, wherein the end lever post of the lever is configured to rotate about the body lever rotation point as the retractable fin moves between the first state and the second state.

14. The method of claim 10, wherein the body is disposed within the thickness.

15. The method of claim 10, wherein the watercraft is a paddle board.

16. The method of claim 10, wherein the lever is detachable from the retractable fin.

17. The method of claim 10, the body comprises a left body and a right body, the left body and the right body separable from one another.

18. The method of claim 10, wherein the body is configured to fit within the thickness of the watercraft.

19. A watercraft fin box comprising:

a body comprising a track aperture and a body lever rotation point, the body forming a body interior void and configured to couple to a water board;

a lever, the lever comprising an end lever post and a medial lever post, the end lever post configured to rotate about the body lever rotation point and the medial lever post configured to engage the track aperture;

a retractable fin configured to attach to the lever; and an elastic element attached to the body;

wherein:

the retractable fin operates in a first state extending from the body such that the elastic element does not impart a force on the lever; and the retractable fin operates in a second state at least partially extending into the body interior void such that the elastic element does impart a force on the lever to urge the retractable fin out from the body interior void.

20. The watercraft fin box of claim 19, wherein:

the elastic element is of spherical shape;

the body comprises a left body and a right body, the left body and the right body separable from one another; and the medial lever post travels within the track aperture as the retractable fin travels between the first state and the second state.

* * * * *